US005799867A

United States Patent [19]

Misawa

[11] Patent Number: 5,799,867

[45] Date of Patent: Sep. 1, 1998

[54] ENGINE-DRIVEN HEAT PUMP APPARATUS AND METHOD FOR STABLE OPERATION OF HEAT PUMP

[75] Inventor: Makoto Misawa, Iwata, Japan

[73] Assignee: Yamaha Hatsudoki Kabushiki Kaisha, Iwata, Japan

[21] Appl. No.: 597,361

[22] Filed: Feb. 8, 1996

[51] Int. Cl.[6] ..... G05D 23/00; F25B 27/00

[52] U.S. Cl. ..... 237/2 B; 62/184; 62/323.1; 62/DIG. 17

[58] Field of Search ..... 237/2 B; 62/DIG. 17, 62/323.1, 238.6, 238.7, 184

[56] References Cited

U.S. PATENT DOCUMENTS 3,421,339 1/1969 Volk et al. ..... 62/323.1 X
4,697,434 10/1987 Yuyama ..... 62/323.1 X

FOREIGN PATENT DOCUMENTS 0443099 8/1991 European Pat. Off. ..... 237/2 B

*Primary Examiner*—William E. Wayner
*Attorney, Agent, or Firm*—Knobbe, Martens, Olson & Bear LLP

[57] ABSTRACT

An engine-driven heat pump apparatus having a refrigerant circulation line which includes at least one inside heat-exchanger for exchanging heat between the air in a room and the refrigerant, and a pressure-controlling device for substantially maintaining the pressure on the high pressure side of the refrigerant circulation line by, for example, narrowing the opening of the expansion valve(s), decreasing the volume of air passing through the inside heat-exchanger(s), recirculating the air passing through the inside heat-exchanger(s), lowering the heat efficiency of the engine when the required quantity of radiated heat from the inside heat-exchanger(s) in use is increased, e.g., when the number of inside heat-exchanger(s) in use is increased, thereby maintaining or increasing heating power in the heating mode, irrespective of the number of inside heat-exchangers in use.

19 Claims, 7 Drawing Sheets

ENGINE-DRIVEN HEAT PUMP APPARATUS AND METHOD FOR STABLE OPERATION OF HEAT PUMP

BACKGROUND

1. Field of the Invention

This invention relates to an engine-driven heat pump apparatus, for heating or cooling the air in a room, comprising at least one inside heat-exchanger installed in the room and an outside heat-exchanger installed outside the room, and, in particular, to such an apparatus which allows for stable operation without lowering heating power when the required quantity of radiated heat from said at least one inside heat-exchanger in use is increased. In addition, this invention relates to a method for stable operation without lowering heating power when the required quantity of radiated heat from said at least one inside heat-exchanger in use is increased.

2. Background of the Art

A heat pump apparatus functions as a heater and a cooler by switching the flow of the refrigerant. That is, an inside heat-exchanger functions as a condenser for heating the room while it functions as an evaporator for cooling the room. An outside heat-exchanger functions in the opposite way. A problem in operating the heat pump apparatus is insufficient heating power when the required quantity of radiated heat from the inside heat-exchanger is increased in the heating mode. For example, in an engine-driven heat pump apparatus having multiple inside heat-exchangers to heat multiple rooms, when the number of inside heat-exchangers in use is increased, and the quantity of radiated heat from the inside heat-exchangers exceeding the rated power of the engine is required, the pressure on the high pressure side of the refrigerant circulation line is decreased, thereby abating the overall heating power. The same phenomenon occurs when the air flow through the inside heat-exchanger is increased so that radiated heat from the inside heat-exchanger is increased and exceeds the rated power of the engine. Prior to discussing this problem, a basic cycle of an engine-driven heat pump apparatus and a p-i chart (pressure and enthalpy chart) will be explained.

FIG. 8 shows a basic cycle of an engine-driven heat pump apparatus in the heating mode, and FIG. 9 shows a p-i chart of the basic cycle of the engine-driven heat pump apparatus.

When a compressor 2 is driven by an engine 1, a vaporized refrigerant in a state (pressure $P_1$ and enthalpy $i_1$) marked (1) in FIG. 9 is compressed in the compressor 2 and changed to a state (pressure $P_2$ and enthalpy $i_2$) marked (2) in FIG. 9, in which the refrigerant is under a high pressure with a high temperature. The power of the compressor 2 necessary to cause the change per unit weight of the refrigerant (the quantity of heat for compression), AL, is expressed as $(i_2-i_1)$.

The refrigerant under a high pressure with a high temperature is introduced to an inside heat-exchanger 7 functioning as a condenser, and liquefied therein as a result of radiating heat of condensation $Q_2$ to the air in a room. The liquefied refrigerant, after passing through the inside heat-exchanger 7, is in a state (pressure $P_2$ and enthalpy $i_3$) marked (3) in FIG. 9, in which the refrigerant is sub-cooled as a result of radiated heat $Q_2$ (i.e., $i_2-i_3$) which heats the interior of the room.

The liquefied refrigerant in a state marked (3) subsequently undergoes reduction of pressure due to an expansion valve 8, and is changed to a state (pressure $P_1$ and enthalpy $i_3$) marked (4) in FIG. 9, in which a portion of the refrigerant is vaporized. The partially vaporized refrigerant is then introduced to an outside heat-exchanger 10 functioning as an evaporator.

Meanwhile, a cooling water, which circulates in a cooling water line via a water pump 24, absorbs exhaust heat from the engine 1 through an exhaust gas heat-exchanger 25 and the engine 1 itself, and exerts the absorbed heat on the refrigerant at the outside heat-exchanger 10. Thus, the refrigerant receives heat from both the outside air and the cooling water at the outside heat-exchanger 10, and vaporizes, in which process the refrigerant is superheated and returns to a state (pressure $P_1$ and enthalpy $i_1$) marked (1) in FIG. 9. After this the same operation as above is repeated. In the above, the quantity of heat $Q_1$ the refrigerant receives at the outside heat-exchanger 10 is expressed as $(i_1-i_3)$.

In the above cycle, by exerting exhaust heat from the engine 1 on the refrigerant, the temperature in the heat cycle is increased by the refrigerant, thereby improving heating power (i.e., radiated heat $Q_2$).

Thus, when the engine load is changed, thereby changing the quantity of exhaust heat, the heating power is accordingly changed. In addition, when the pressure either on the high pressure side or on the low pressure side is changed, and when the volume of the refrigerant circulating through the refrigerant circulation line is changed, the heating power is accordingly changed., In a heat pump apparatus having multiple inside heat-exchangers, when the number of inside heat-exchangers in use is more than that rated for the power of the engine, the volume of the refrigerant circulating through each inside heat-exchanger is decreased (the flow rate of the refrigerant discharged from the compressor may not be significantly increased) , resulting in a decrease in pressure $P_2$ on the high pressure side, i.e., downstream of the compressor and upstream of the expansion valve, such that the heating power becomes lower than the rated heating power, as shown in FIG. 10. Also, when the air flow passing through one of the inside heat-exchangers in use becomes stronger without changing the number of inside heat-exchangers in use, pressure $P_2$ is decreased via different mechanisms, resulting in the same problem, i.e., insufficient heating power in the heating mode.

SUMMARY OF THE INVENTION

The present invention has exploited an engine-driven heat pump apparatus for heating and cooling a room, having at least one inside heat-exchanger, especially when the required quantity of radiated heat therefrom is changed while in the heating mode. An objective of the present invention is to provide an engine-driven heat pump apparatus and a method for stable operation of an engine-driven heat pump apparatus which allow for heating at least one room without lowering the heating power.

Namely, one important aspect of the present invention is an engine-driven heat pump apparatus comprising a refrigerant circulation line through which a refrigerant circulates, said refrigerant circulation line comprising: an engine-driven compressor for circulating said refrigerant; a cooling water circulation line through which a cooling water for cooling said engine circulates; a cooling water-refrigerant heat-exchanger for exchanging heat between said cooling water and said refrigerant; at least one inside heat-exchanger for exchanging heat between said refrigerant and the air inside a room; an outside heat-exchanger for exchanging heat between said refrigerant and the air outside said room;

an expansion valve arranged in series with each inside heat-exchanger; a four-way valve for reversing the flow of said refrigerant at said at least one inside heat-exchanger and at said outside heat-exchanger; and a pressure-controlling device for controlling the pressure in said refrigerant circulation line downstream of said compressor and upstream of said expansion valve, when the required quantity of radiated heat from said at least one inside heat-exchanger in use is changed. By maintaining the pressure on the high pressure side of the refrigerant circulation line (preferably maintaining the difference in pressure between the high pressure side and the low pressure side), irrespective of the number of inside heat-exchangers in use, the heating power in the heating mode can be maintained or increased. Preferable means for controlling the pressure include devices for controlling the opening of said expansion valve, for controlling the volume of air passing through said at least one inside heat-exchanger, for controlling the temperature of air flowing into said at least one inside heat-exchanger by returning a portion of the air flowing out of said at least one inside heat-exchanger to an air inlet of said at least one inside heat-exchanger, and for controlling the heat efficiency of said engine.

Another important aspect of the present invention is to provide a method for stable operation of a heat pump apparatus comprising, in a refrigerant circulation line through which a refrigerant circulates, an engine-driven compressor for circulating said refrigerant; a cooling water circulation line through which a cooling water for cooling said engine circulates; at least one inside heat-exchanger for exchanging heat between said refrigerant and the air inside a room; an outside heat-exchanger for exchanging heat between said refrigerant and the air outside said room; and an expansion valve arranged in series with each inside heat-exchanger; a four-way valve for reversing the flow of said refrigerant at said at least one inside heat-exchanger and at said outside heat-exchanger, said method comprising the step of controlling the pressure in said refrigerant circulation line downstream of said compressor and upstream of said expansion valve, when the required quantity of radiated heat from said at least one inside heat-exchanger in use is changed, in such a way as to maintain said pressure. As described above in connection with the apparatus, by maintaining the pressure on the high pressure side on the refrigerant circulation line, irrespective of the number of inside heat-exchangers in use, the heating power in the heating mode can be maintained or increased. In particular, the step of controlling said pressure is preferably conducted when the required quantity of radiated heat is increased and exceeds the rated power of the engine, i.e., the flow rate of the refrigerant or the like may not be able to be significantly adjusted or exhaust heat from the engine cannot be increased because the r.p.m.'s of the engine cannot be increased without loosing output power when the engine is driven with the rated power.

In the above method when the required quantity of radiated heat exceeds the rated power of the engine in the heating mode, when the step of controlling said pressure comprises narrowing the opening of said expansion valve, a decrease in pressure on the high pressure side and an increase in pressure on the low pressure side can be effectively prevented. Also, when the step of controlling said pressure comprises decreasing the volume of air passing through said at least one inside heat-exchanger, radiated heat from the inside heat-exchanger is decreased so that the volume of vaporous refrigerant passing through the expansion valve is increased, thereby increasing the portion of vaporous refrigerant which flows into the outside heat-exchanger and the compressor, i.e., thereby increasing the pressure after the compressor. Further, when the step of controlling said pressure comprises raising the temperature of air flowing into said at least one inside heat-exchanger by returning a portion of the air flowing out of said at least one inside heat-exchanger to an air inlet of said at least one inside heat-exchanger, radiated heat from the inside heat-exchanger is decreased, thereby exhibiting the same effect as above. As a result, by employing at least one of the above-mentioned methods, even though the required quantity of radiated heat from the inside heat-exchanger(s) is increased and exceeds the rated power of the engine, the pressure on the high pressure side of the refrigerant circulation line can be substantially maintained, and the gross heating power can be substantially maintained.

Further, in the method, when the step of controlling said pressure comprises lowering the heat efficiency of said engine, exhaust heat from the engine is increased, and can efficiently compensate for relatively insufficient heat of evaporation. Heretofore, the required quantity of radiated heat from the inside heat-exchanger(s) is increased while heat of evaporation in the outside heat-exchanger is not increased. Thus, even if all the refrigerant is effectively used by balancing the radiated heat from the inside heat-exchanger(s) and the heat of evaporation in the outside heat-exchanger, the gross heating power may not be increased but remains the same. However, when exhaust heat from the engine is used to compensate for relatively insufficient heat of evaporation, the radiated heat from the inside heat-exchanger(s) can be increased, thereby increasing the gross heating power. Thus, the use of exhaust heat from the engine is preferably combined with the aforesaid methods.

DETAILED DESCRIPTION OF THE PREFERRED EMBODIMENT

Figure 1:
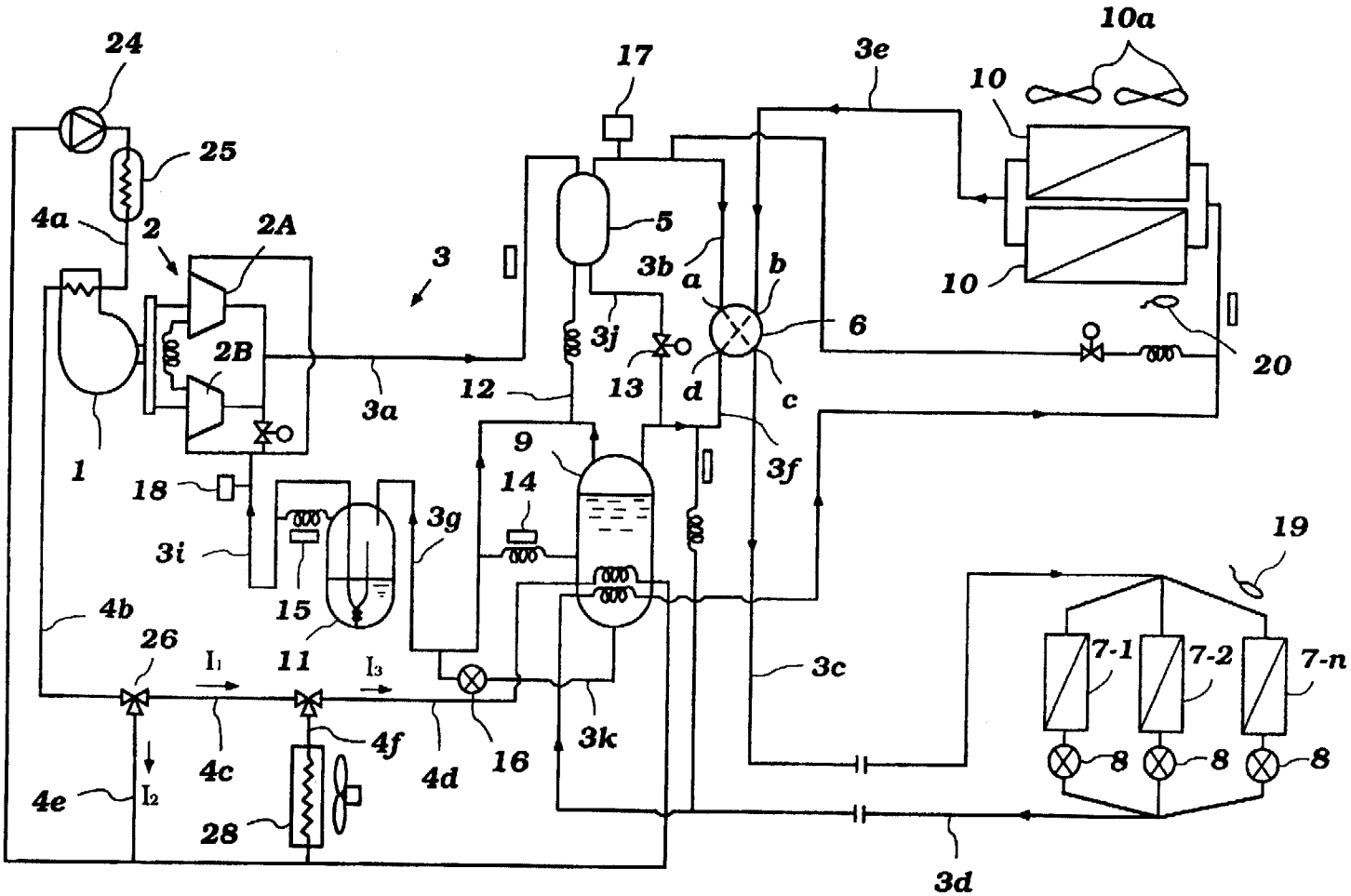
FIG. 1 is a schematic circuit illustrating basic structures of an engine-driven heat pump apparatus according to the present invention.

In an engine-driven heat pump apparatus having at least one inside heat-exchanger, the required quantity of radiated heat from the inside heat-exchanger(s) is considerably changeable. For example, if the rated power of the engine is just sufficient for air conditioning two rooms, i.e., two inside heat-exchangers, in the heating mode under given conditions, the required quantity of radiated heat to heat two rooms under the conditions is 100% of capacity based on the rated power of the engine. If three rooms are heated using the same system under the same conditions except that three inside heat-exchangers are used, the required quantity of radiated heat is increased to 150% of capacity based on the rated power of the engine. If two rooms are heated using the same system under the same conditions except that air flow through one of the inside heat-exchangers increases so as to double radiated heat from the inside heat-exchanger, the required quantity of radiated heat is also increased to 150% of capacity based on the rated power of the engine.

Heretofore, when the required quantity of radiated heat is increased by increasing the number of inside heat-exchangers in use, the number of the expansion valves is also increased, i.e., the total area of the orifices of the expansion valves is increased, thereby lessening a pressure drop at the expansion valve. Thus, the pressure on the low pressure side is increased, thereby lessening the difference in pressure between the high pressure side and the low pressure side, meaning that the compressor load is lessened. If the engine power is constant, the volume of the refrigerant flowing into the compressor is increased. In addition, the heating surface area is physically increased. As a result, the radiated heat from the inside heat-exchangers is increased. However, heat of evaporation in the outside heat-exchanger is, conversely, decreased because the pressure on the low pressure side is increased, i.e., the difference in temperature between the outside air and the vapor-liquid refrigerant is lessened. Thus, the radiated heat from the inside heat-exchangers surpasses the heat of evaporation in the outside heat-exchanger beyond the balance point. Accordingly, the amount of vaporous refrigerant flowing into the compressor cannot be increased, and the orifice area of the expansion valves is increased, thereby decreasing the pressure upon the compressor, i.e., heating power is decreased. The problem resides in an imbalance between the radiated heat and the heat of evaporation. Also in a case that the required quantity of radiated heat is increased by, for example, increasing the air flow through the inside heat-exchange(s) without increasing the number of inside heat-exchangers in use, the imbalance between the radiated heat and the heat of evaporation causes the same problem, i.e., eventually decreasing the pressure on the high pressure side, thereby decreasing heating power of the heat pump apparatus.

One of the most effective methods for balancing the radiated heat and the heat of evaporation so as to prevent a decrease in pressure on the high pressure side is the step of controlling the opening of the expansion valve(s). As described above, if the orifice area is made small, a decrease in pressure on the high pressure side can be prevented. Accordingly, the heat cycle can run in the same way as in the rated operation to substantially maintain heating power, irrespective of changes in the required quantity of radiated heat. Another method for balancing the radiated heat and the heat of evaporation so as to prevent a decrease in pressure on the high pressure side is the step of controlling the volume of air passing through the inside heat-exchanger(s). By this method, the portion of vaporous refrigerant flowing into the expansion valve can be adjusted, while the refrigerant flow from the compressor remains constant, thereby adjusting the pressure at the inside heat exchanger(s) so as to balance the radiated heat and the heat of evapolation. The step of controlling the temperature of air flowing into the inside heat-exchanger(s) by returning a portion of the air flowing out of the inside heat-exchanger(s) to an air inlet of the inside heat-exchanger(s) can be employed to obtain the same effects as the above step. Accordingly, the heat cycle can also run in the same way as in the rated operation to maintain heating power, irrespective of changes in the required quantity of radiated heat.

One of the most effective methods for increasing heat of evaporation in the outside heat-exchanger is the step of controlling the heat efficiency of the engine, in which the pressure on the high pressure side can be substantially maintained. According to this method, not only balancing the radiated heat and the heat of evaporation but also increasing the heat of evaporation can be achieved, thereby actually increasing heating capacity in proportion to an increase in the required quantity of radiated heat. When the heat efficiency of the engine is lowered, more energy can be allocated for exhaust heat which can be transferred to the refrigerant via a cooling water for the engine. The step of lowering the heat efficiency of the engine typically comprises controlling at least one of (a) the ignition timing of the engine, (b) the opening and closing timing of an intake port valve and an exhaust port valve, and (c) the opening of a fuel gas-controlling valve.

The step of controlling exhaust heat comprising lowering the heat efficiency of the engine is preferably conducted with the step selected from the group consisting of controlling the opening of the expansion valve(s), controlling the volume of air passing through the inside heat-exchanger(s), and controlling the temperature of air flowing into the inside heat-exchanger(s) by returning a portion of the air flowing out of the inside heat-exchanger(s) to an air inlet of the inside heat-exchanger(s).

The present invention will be further explained with reference to an example based on FIGS. 1–10.

Basic Structures of Heat Pump Apparatus

FIG. 1 is a schematic circuit illustrating basic structures of an engine-driven heat pump apparatus according to the present invention.

In FIG. 1, the engine-driven heat pump apparatus is provided with a water-cooled gas engine 1 and the compressors 2 (2A and 2B) driven by the gas engine 1. The heat pump apparatus comprises a refrigerant circulation line 3 which is a closed loop including compressors 2A and 2B, and a cooling water circulation line 4 which a closed loop including a water pump 24, as shown in FIG. 1. The refrigerant circulation line 3 is a circuit through which a refrigerant such as freon circulates via the compressors 2, which refrigerant circulation line includes a refrigerant line 3*a* from outlets of the compressors 2A and 2B to an oil separator 5, a refrigerant line 3*b* from the oil separator 5 to a four-way valve 6 in the heating mode, a refrigerant line 3*c* from the four-way valve 6 to multiple inside heat-exchangers 7 numbered from 7-1 to 7-n (n is an integer n>1), a refrigerant line 3d from the inside heat-exchangers 7 to two outside heat-exchangers 10 through expansion valves 8 and through the inside of the accumulator 9, a refrigerant line 3e from the outside heat-exchangers 10 to the four-way valve 6, a refrigerant line 3f from the four-way valve 6 to the accumulator 9 in the heating or cooling mode, a refrigerant line 3g from the accumulator 9 to a sub-accumulator 11, and a refrigerant line 3i from the sub-accumulator 11 to each inlet of the compressors 2A and 2B.

An oil return line 12 and a bypass line 3j are led from the oil separator 5, the oil return line 12 connects the refrigerant line 3g, and the bypass line 3j connects the refrigerant line 3f and is provided with a bypass valve 13. The accumulator 9 and the sub-accumulator 11 are provided with temperature sensors 14 and 15, respectively. The bottom of the accumulator 9 is connected to the refrigerant line 3g via a bypass line 3k which is mainly used for oil return, and the bypass line 3k is provided with a bypass valve 16.

Figure 2:
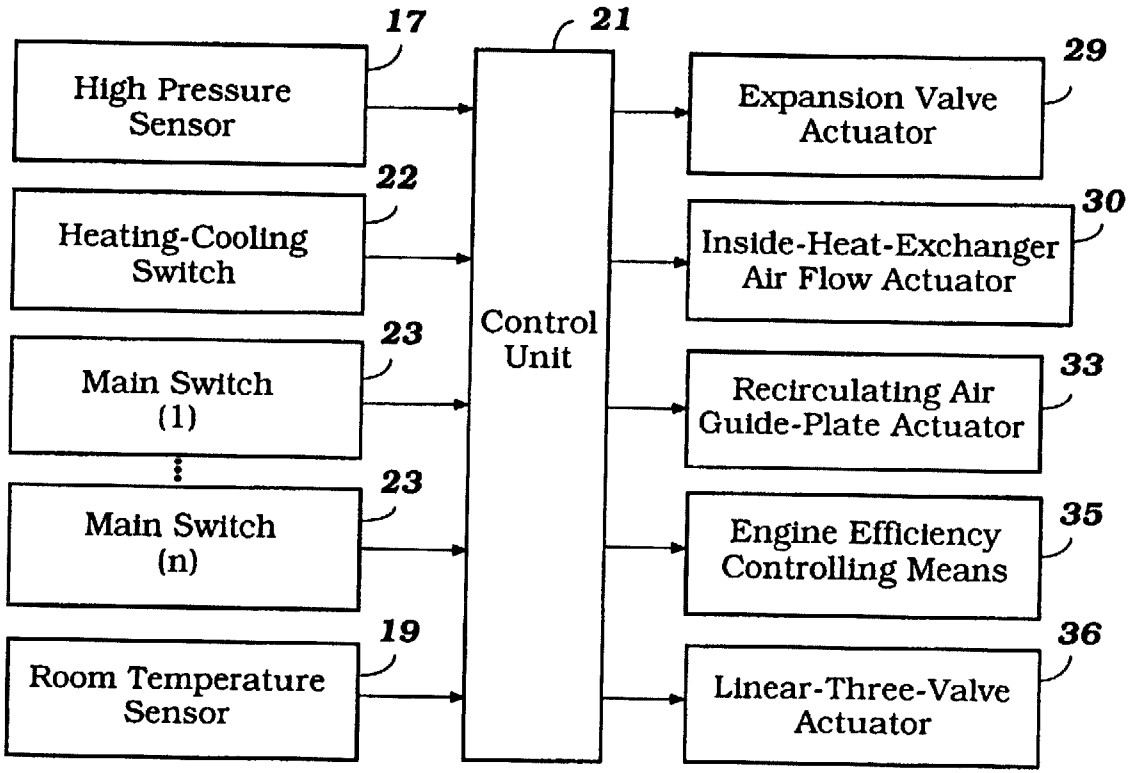
FIG. 2 is a block chart illustrating a control system used in an engine-driven heat pump apparatus according to the present invention.

In the above refrigerant circulation line 3, a high pressure sensor 17 for measuring the pressure on the condenser side is provided in the refrigerant line 3b, and a low pressure sensor 18 for measuring the pressure on the evaporator side is, provided in the refrigerant line 3i. A room temperature sensor 19 for measuring the room temperature is provided near the inside heat-exchangers 7, and an outside temperature sensor 20 for measuring the outside temperature is provided near the outside heat-exchangers 10. The high pressure sensor 17, the low pressure sensor 18, the room temperature sensor 19 and the outside temperature sensor 20 are connected to the control unit 21 as shown in FIG. 2. A heating-cooling switch 22 and a main switch 23 for each inside heat-exchanger numbered from 1 to n (n is a integer>1) are also connected to the control unit 21.

Cooling Water Line

The cooling water circulation line 4 is a line for circulating a cooling water for cooling the gas engine 1 via the water pump 24. The cooling water circulation line 4 is composed of: a cooling water line 4a from the outlet of the water pump 24 to the cooling water inlet of the gas engine through the exhaust gas heat-exchanger 25; a cooling water line 4b from the cooling water outlet of the gas engine 1 to a temperature-sensitive three-way valve 26; a cooling water line 4c from the temperature-sensitive three-way valve 26 to a linear-type three-way valve 27; a cooling water line 4d from the linear-type three-way valve to the inlet of the water pump 24 through the accumulator 9; a cooling water line 4e from the temperature-sensitive three-way valve 26 to the cooling water line 4d; and a cooling water line 4f from the linear-type three-way valve 27 to the cooling water line 4d. The cooling water line 4f includes a heat-exchanger 28 for radiating heat.

Figure 3:
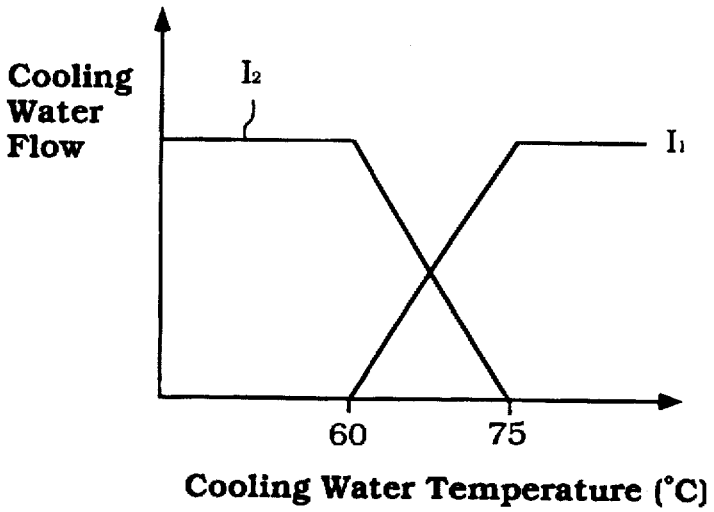
FIG. 3 is a schematic graph showing a specific characteristic of a temperature-sensitive three-way valve used in a cooling water circulation line.

The temperature-sensitive three-way valve 26 functions in such a way that when the cooling water temperature is not higher than 60° C., for example, as shown in FIG. 3 (the temperature is detected by a thermostat provided with the three-way valve), the cooling water line 4c is completely closed while the cooling water line 4e is completely open, thereby leading the cooling water only to the cooling water line 4e. When the cooling water temperature is higher than 60° C. but not higher than 75° C., for example, as shown in FIG. 3, the cooling water line 4c partially opens while the cooling water line 4e partially closes, thereby leading the cooling water both to the cooling water lines 4c and 4e. When the cooling water temperature is higher than 75° C., for example, as shown in FIG. 3, the cooling water line 4c is completely opened while the cooling water line 4e is completely closed, thereby leading the cooling water only to the cooling water line 4c. $I_1$ and $I_2$ indicate the amount of cooling water circulating through the cooling water lines 4c and 4e, respectively.

Figure 4:
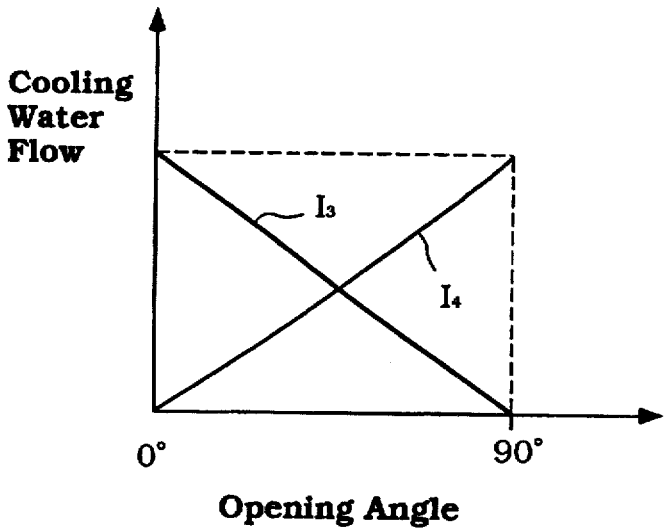
FIG. 4 is a schematic graph showing a specific characteristic of a linear-type three-way valve used in a cooling water circulation line.

The linear-type three-way valve 27 has the characteristics shown in FIG. 4, for example. In FIG. 4, $I^3$ and $I^4$ indicate the amount of cooling water circulating through the cooling water lines 4d and 4f. The linear-type three-way valve permits the volume of cooling water $I_3$ and $I_4$ through the respective cooling water lines 4d and 4f to increase linearly in association with an increase in the opening of the valve, as shown in the Figure. Thus, when the opening angle of the valve 27 is 0°, the cooling water line 4d is completely open while the cooling water line 4f is completely closed, thereby leading the full volume of cooling water $I_1$ (=$I_3$) circulating through the cooling water line 4c to the accumulator 9. When the opening angle of the valve 27 is 90°, the cooling water line 4d is completely closed while the cooling water line 4f is completely open, thereby leading the full volume of cooling water $I_1$ (=$I_4$) circulating through the cooling water line 4c to the heat-exchanger 28 for radiating heat, by bypassing the accumulator 9.

The above-mentioned refrigerant-heating system with the use of exhaust heat from the engine via engine cooling water can be formed of a heat-exchanger of double-tube type to exchange heat between the engine cooling water and the refrigerant, instead of the use of the accumulator provided with a channel through which the cooling water passes in the above embodiment. Exchanging heat between the cooling water and the refrigerant can be conducted upstream of the compressor, e.g., not only in the accumulator 9 but also in the refrigerant line 3e, 3f, 3g, or 3i, or in the sub-accumulator 11.

Heating Operation of Heat Pump Apparatus

Heating operation of the above heat pump apparatus will be explained with reference to a p-i chart shown in FIG. 9.

Figure 9:
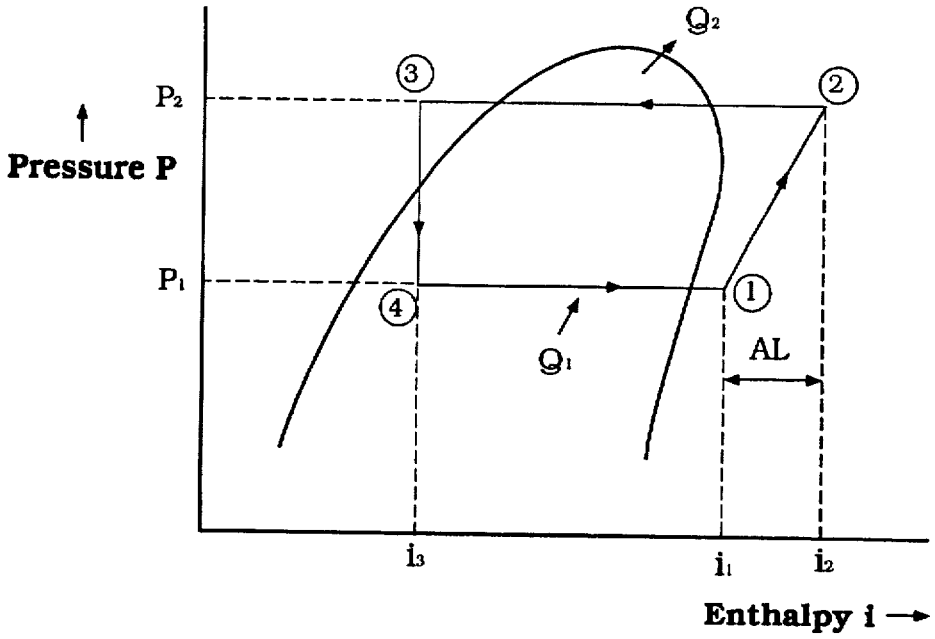
FIG. 9 is a p-i chart showing changes in pressure and enthalpy of a refrigerant in a heating or cooling cycle.
Figure 10:
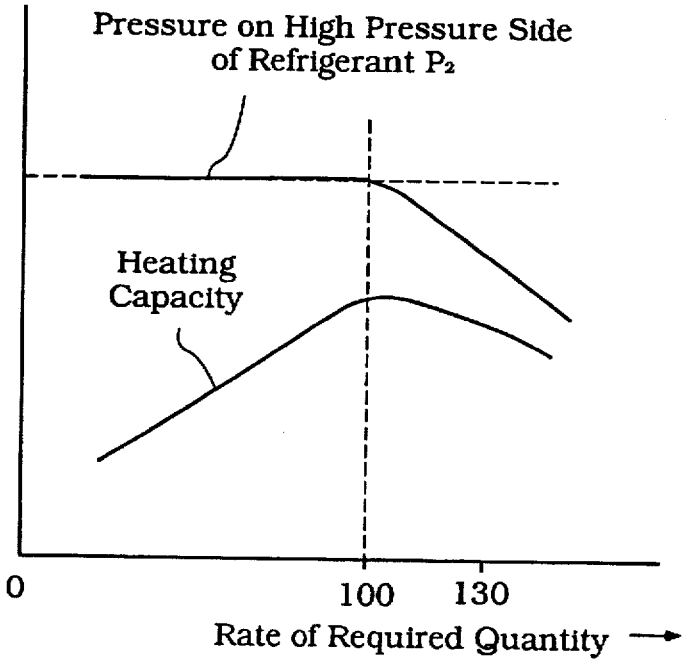
FIG. 10 is a schematic graph showing the relationship between heating power and the pressure on the high pressure side of the refrigerant circulation line versus the ratio of the required quantity of radiated heat to the rated quantity of radiated heat, according to a conventional heat pump.

When the compressors 2A and 2B are driven by engine revolutions as described above, the vaporized refrigerant in a state marked (1) in FIG. 9 (pressure $P_1$ and enthalpy $i_1$) is introduced into the compressors 2A and 2B from the refrigerant circulation line 3i, compressed, and changed to a state marked (2) in FIG. 9 (pressure $P_2$ and enthalpy $i_2$) in which the refrigerant is under a high pressure with a high temperature. The necessary power of the compressors 2A and 2B per unit weight of the refrigerant, AL, is expressed as ($i_2$–$i_1$). The pressure of the refrigerant introduced into the compressors 2A and 2B, $P_1$, is detected by the low pressure sensor 18, and input into the control unit 21.

The above vaporized refrigerant under a high pressure with a high temperature is led to the oil separator 5 through the refrigerant line 3a, and the oil is removed therefrom by the oil separator 5. The oil-free vaporized refrigerant is moved to the four-way valve 6 through the refrigerant line 3b. The oil separated from the refrigerant by the oil separator 5 is returned to the refrigerant line 3g through the oil return line 12. The pressure of the refrigerant, under a high pressure with a high temperature, circulating through the refrigerant line 3b, $P_2$ (pressure loss is negligible), is detected by the high pressure sensor 17, and input into the control unit 21.

In the heating mode, port "a" and port "b" of the four-way valve 6 are communicated with port "c" and port "d", respectively. The vaporized refrigerant under a high pressure with a high temperature flows into the refrigerant line 3c via the four-way valve 6 and then the inside heat-exchangers 7 functioning as condensers. The vaporized refrigerant under a high pressure with a high temperature introduced into the inside heat-exchangers 7 is liquefied while radiating heat of condensation $Q_2$ to the air in a room, and sub-cooled to a state marked (3) in FIG. 9 (pressure $P_2$ and enthalpy $i_3$) so as to liquefy the refrigerant, thereby heating the room using radiated heat $Q_2$ ($=i_2-i_3$).

The refrigerant under a high pressure liquefied at the inside heat-exchangers 7 undergoes drastic reduction of pressure by the expansion valves 8, and is changed to a state marked (4) in FIG. 9 (pressure $P_1$ and enthalpy $i_3$), in which a portion of the refrigerant is vaporized and the vapor-liquid refrigerant flows in the refrigerant line 3d towards the outside heat-exchangers 10.

Meanwhile, the cooling water circulating in the cooling water circulation line 4 by operation of the water pump 24 is pushed out of the water pump 24, flows in the cooling water line 4a, absorbs heat from the exhaust gas heat-exchanger 25, and further absorbs heat from the gas engine 1, thereby cooling the gas engine 1 while absorbing heat. The cooling water used for cooling the gas engine 1 flows in the cooling water line 4b, and reaches the temperature-sensitive three-way valve 26. In the above, when the cooling water temperature is low at the beginning of operation of the gas engine 1, e.g., not higher than 60° C., as describe earlier with reference to FIG. 3, the temperature-sensitive three-way valve 26 completely closes the cooling water line 4c while completely opening the cooling water line 4e, thereby returning all the cooling water to the water pump 24 through the cooling water line 4e. Accordingly, the temperature of the cooling water is elevated, thereby quickly warming the gas engine 1 which is cool. When the cooling water temperature is higher than 60° C. but not higher than 75° C., the cooling water line 4c starts opening while the cooling water line 4e starts closing, and when the cooling water temperature is higher than 75° C., the cooling water line 4c is completely open while the cooling water line 4e is completely closed, thereby leading all the cooling water to the linear-type three-way valve 27 through the cooling water line 4c. If the opening angle of the valve 27 is set at 0° in the heating mode, all the cooling water flows into the accumulator 9 through the cooling water line 4d, as shown in FIG. 4. In the accumulator 9, the refrigerant circulating through the refrigerant line 3d and the liquefied refrigerant accommodated in the accumulator 9 are heated by the cooling water circulating through the cooling water line 4d, i.e., exhaust heat from the gas engine 1 (transmitted heat from the exhaust gas and absorbed heat from the gas engine 1 through the cooling water) is exerted on the refrigerant. The refrigerant circulating through the refrigerant line 3d flows into the outside heat-exchangers 10 after being heated by the exhaust heat from the gas engine 1 in the accumulator 9 as described above, in which outside heat-exchanger the refrigerant is vaporized by absorbing heat of evaporation from the outside air. If the temperature of the outside air is higher than a given level, the fans 10a of the outside heat-exchangers 10 are operated, thereby enhancing absorption of heat from the outside air in the outside heat-exchangers 10.

The refrigerant moves from the outside heat-exchangers 10 to the four-way valve 6 through the refrigerant line 3e, in which port "b" and port "d" of the four-way valve 6 are communicated with each other in the heating mode, thereby leading the refrigerant to the refrigerant line 3f via the four-way valve 6, and reaching the accumulator 9.

In the accumulator 9, the vapor-liquid refrigerant is separated into the vapor refrigerant and the liquid refrigerant. The liquid refrigerant receives exhaust heat from the gas engine 1 via the cooling water circulating through the cooling water line 4d, and partially vaporizes.

The vapor refrigerant in the accumulator 9 is moved to the sub-accumulator 11, and further moved to the compressors 2A and 2B through the refrigerant line 3i. The state of the vapor refrigerant is returned to a state marked (1) in FIG. 9 (pressure $P_1$ and enthalpy $i_1$), and the vapor refrigerant is again compressed by the compressors 2A and 2B, thereby repeating the same operation as described above.

The refrigerant receives exhaust heat from the gas engine 1 in the accumulator 9 and heat from the outside air in the outside heat-exchangers 10, during a period between reduction of pressure by the expansion valves 8 and introduction to the compressors 2A and 2B, whereby the refrigerant is vaporized and further superheated by receiving heat $Q_1$ ($=i_1-i_3$).

Accordingly, in the heating mode, exhaust heat from the gas engine 1 is exerted on the refrigerant through the cooling water absorbing heat, and added to heat originally radiated from the inside heat-changers 7, thereby improving heating power to obtain radiated heat $Q_2$.

Heating Operation with Increased Quantity of Radiated Heat

However, in operation of multiple inside heat-exchangers, when the number of inside heat-exchangers 7 exceeds that rated for the power of the engine, pressure $P_2$ on the high pressure side of the refrigerant circulation line is decreased, thereby reducing the heating capacity, i.e., the heating capacity is lower than the rated capacity.

In this embodiment, by substantially maintaining pressure $P_2$ on the high pressure side of the refrigerant circulation line during heating operation, irrespective of the number of inside heat-exchangers in use (or a change in the required quantity of radiated heat from the same inside heat-exchanger), high heating capacity can be constantly achieved. That is, by controlling pressure $P_2$ on the high pressure side of the refrigerant circulation line so as to remain constant, irrespective of the required quantity of radiated heat, the amount of the refrigerant flowing through the expansion valve(s) 8 can be reduced so as to decrease the radiated heat sufficiently for balancing the radiated heat and the heat of evaporation, or the heat of evaporation can be increased sufficiently for balancing the radiated heat and the heat of evaporation, thereby allowing for efficient use of the refrigerant, i.e., heating capacity can remain constant or increase. In the above, by either an decrease in the radiated heat or an increase in the heat of evaporation, heat balance can be achieved. In order to realize the former, the step of controlling the opening of the expansion valve(s) 8, the step of controlling the volume of air passing through the inside heat-exchanger(s) 7, the step of controlling the temperature of air flowing into the inside heat-exchanger(s) 7 by returning a portion of the air flowing out of the inside heat-exchanger(s) 7 to an air inlet of the inside heat-exchanger(s) 7, or the like are very effective. In order to realize the latter, the step of controlling the heat efficiency of the engine 1 is very effective. By employing the steps for the former and the latter, heating capacity can be greatly improved. Incidentally, although the difference in pressure between $P_2$ and $P_1$ ($P_2-P_1$) can be a good indicator because pressure $P_1$ on the low pressure side of the refrigerant circulation line are also changed when the required quantity of radiated heat is changed, pressure $P_2$ is a sufficient indicator to control heating power because pressures $P_2$ and $P_1$ are associated with each other.

An example of the step of controlling the openings of the expansion valve 8 is as follows:

The control unit 21 detects the number of inside heat-exchangers 7 in use by detecting ON/OFF of the main switches 23 shown in FIG. 2. The control unit 21 then transmits control signals, which corresponds to the number of inside heat-exchangers in use, to an actuator 29 for changing the opening of each expansion valve 8 (see FIG. 2), thereby controlling the opening of each expansion valve 8. In particular, the opening of the expansion valve 8 is narrowed in association with an increase in the number of inside heat-exchangers in use, thereby remaining pressure $P_2$ on the high pressure side of the refrigerant circulation line. The amount of the refrigerant passing through the expansion valves are decreased, thereby reducing the radiated heat to balance the heat of evaporation. Heating capacity may not be increased but remains constant, irrespective of the number of inside heat-exchangers in use.

An example of the step of controlling the air flow through the inside heat-exchangers 7 is as follows:

The control unit 21 detects the number of inside heat-exchangers 7 in use by detecting ON/OFF of the main switches 23 shown in FIG. 2. The control unit 21 then transmits control signals, which corresponds to the number of inside heat-exchangers in use, to an actuator 30 for changing air flow passing through each inside heat-exchanger 7 (see FIG. 2), thereby controlling the air flow through each inside heat-exchanger 7. In particular, the air flow through each inside heat-exchanger 7 is reduced, e.g., switching from "strong" to "weak", in association with an increase in the number of inside heat-exchangers in use. As a result, the heat transfer coefficient at the inside heat-exchanger is lowered, and thus the portion of vaporous refrigerant passing through the expansion valve 8 is increased, i.e., the refrigerant flow based on weight passing through the expansion valve is decreased while the refrigerant flowing out of the compressor remains constant, thereby remaining pressure $P_2$ on the high pressure side of the refrigerant circulation line. The radiated heat from the inside heat-exchanger 7 is reduced. Heating capacity may not be increased but at least remains constant, irrespective of the number of inside heat-exchangers in use. Incidentally, at the inside heat-exchanger 7 whose main switch 23 is off, the expansion valve 8 can be closed or completely opened, and the air flow rate must be zero. On the other hand, when the number of inside heat-exchangers in use is decreased, the pressure on the high pressure side of the refrigerant line is increased, i.e., the more the inside heat-exchangers 7 not operated, the higher the pressure on the high pressure side of the refrigerant line created. The opening of the inside heat-exchanger 7 which is on should be made larger, or air flow should be increased.

Figure 5:
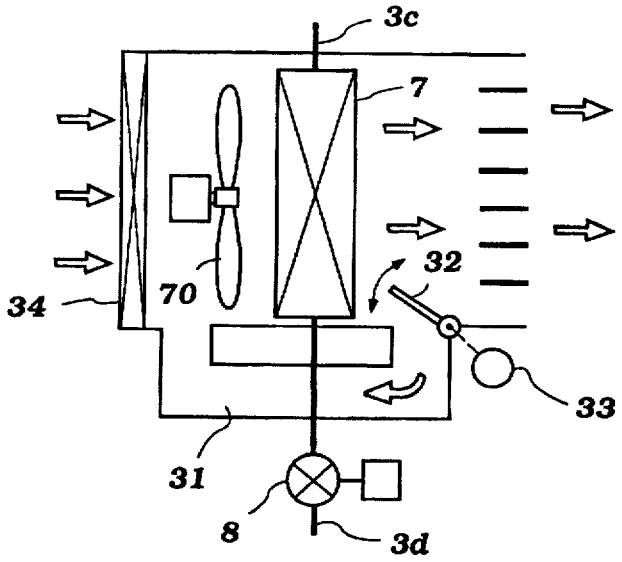
FIG. 5 is a schematic view showing an embodiment of an inside heat-exchanger provided with an air circulation system.

An example of the step of controlling recirculation of air through the inside heat-exchangers 7 is as follows:

As shown in FIG. 5, an air recirculation conduit 31 which communicates the inlet and the outlet of the inside heat-exchanger 7 is formed, and a guide plate 32 is disposed in the air recirculation conduit 31 at the opening downstream of the air flow. The opening of the guide plate 32 is controlled by an acutuater 33 for moving the guide plate 32 for changing recirculating air. In the above structures, the air flowing out of the inside heat-exchanger 7 through an air filter 34 with an air fan 7*a* has a high temperature. By recirculating a portion of the air through the air recirculation conduit 31, the temperature of the air flowing into the inside heat-exchanger 7 is increased. The temperature can be controlled by the opening of the guide plate 32, i.e., by the air flow through the air recirculation conduit 31.

That is, the control unit 21 detects the number of inside heat-exchangers 7 in use by detecting ON/OFF of the main switches 23 shown in FIG. 2. The control unit 21 then transmits control signals, which corresponds to the number of inside heat-exchangers in use, to an actuator 33 for adjusting guide plate 32 (see FIG. 2) in order to control the opening of the guide plate 32, thereby controlling the temperature of the air flowing into the inside heat-exchanger 7. In particular, the recirculated air is increased in association with an increase in the number of inside heat-exchangers in use. As a result, the heat transfer coefficient at the inside heat-exchanger is lowered, and thus the portion of vaporous refrigerant passing through the expansion valve 8 is increased, i.e., the refrigerant flow based on weight passing through the expansion valve is decreased while the refrigerant flowing out of the compressor remains constant, thereby remaining pressure $P_2$ on the high pressure side of the refrigerant circulation line. The radiated heat from the inside heat-exchanger 7 is reduced. Heating capacity may not be increased but at least remains constant, irrespective of the number of inside heat-exchangers in use.

Figure 6:
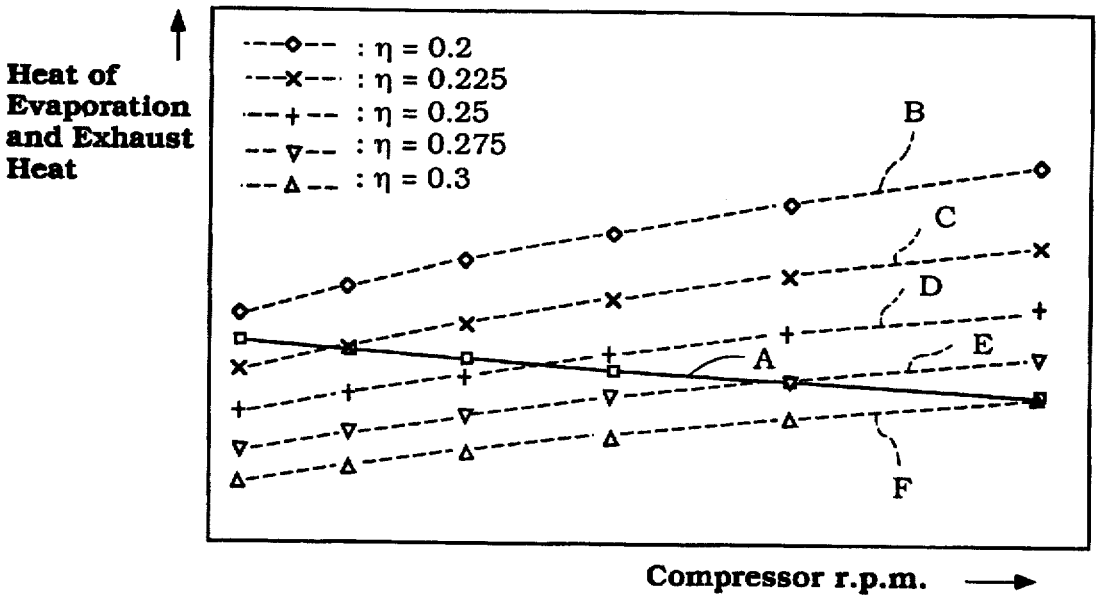
FIG. 6 is a schematic graph showing an example of the relationship between the r.p.m.'s of a compressor and heat of evaporation and exhaust heat, with a parameter of heat efficiency of the engine.

An example of the step of controlling exhaust heat from the engine by lowering the heat efficiency of the engine is as follows:

FIG. 6 is a schematic graph showing an example of the relationship between the r.p.m.'s of a compressor and heat of evaporation and exhaust heat, with a parameter of heat efficiency $\eta$ of the gas engine. Solid line A indicates heat of evaporation, broken lines B-F indicate the quantity of exhaust heat when heat efficiency $\eta$=0.2, 0.225, 0.25, 0.275, and 0.3. As is clearly shown, the lower the heat efficiency $\eta$, the more the exhaust heat obtained per the quantity of heat of evaporation.

The control unit 21 detects the number of inside heat-exchangers 7 in use by detecting ON/OFF of the main switches 23 shown in FIG. 2. The control unit 21 then transmits control signals, which corresponds to the number of inside heat-exchangers in use, to a means 35 for controlling the engine efficiency (see FIG. 2), thereby controlling the exhaust heat from the engine. In particular, the heat efficiency of the engine is decreased in association with an increase in the number of inside heat-exchangers in use, thereby remaining pressure $P_2$ on the high pressure side of the refrigerant circulation line. In FIG. 2, a linear three-valve acutuater 36 is also connected to the control unit 21, for changing the openings of the valves 26 and 27 to control the cooling water flowing ratio in the two directions at the valves 26 and 27. Since the heat of evaporation in the outside heat-exchangers 10 is increased, heating capacity is indeed increased when the number of inside heat-exchangers in use is increased.

In this embodiment, as a means for lowering heat efficiency of the gas engine, a method for controlling at least one of (a) the ignition timing of the engine, (b) the opening and closing timing of an intake port valve and an exhaust port valve, and (c) the opening of a fuel gas-controlling valve, is employed.

In controlling the ignition timing, the control unit 21 delays ignition by a spark plug based on at least one of the following factors: pressure $P_2$ of the refrigerant on the condenser side (the inside heat-exchangers in the heating mode) detected by the high pressure sensor 17, the revolution speed of the engine, the crank angle, the opening of the throttle valve, and the boost value. When the ignition timing is delayed as described above, power supplied by combustion of gas, which is used for operation of a piston, is decreased, thereby slightly decreasing the output of the gas engine 1; however, the opening of the throttle valve is enlarged, and the temperature of exhaust gas is increased accordingly. Thus, the cooling water absorbs more exhaust heat in the exhaust gas heat-exchanger 25, thereby increasing heating power. When the output of the gas engine is lowered, the revolution speed of the gas engine will decrease by the degree of the decrease in the output, due to the load of the compressors 2. However, By increasing the amount of mixed gas supplied to a cylinder of the gas engine, it is possible to compensate for the decrease in the output and in the revolution speed of the gas engine.

Figure 11:
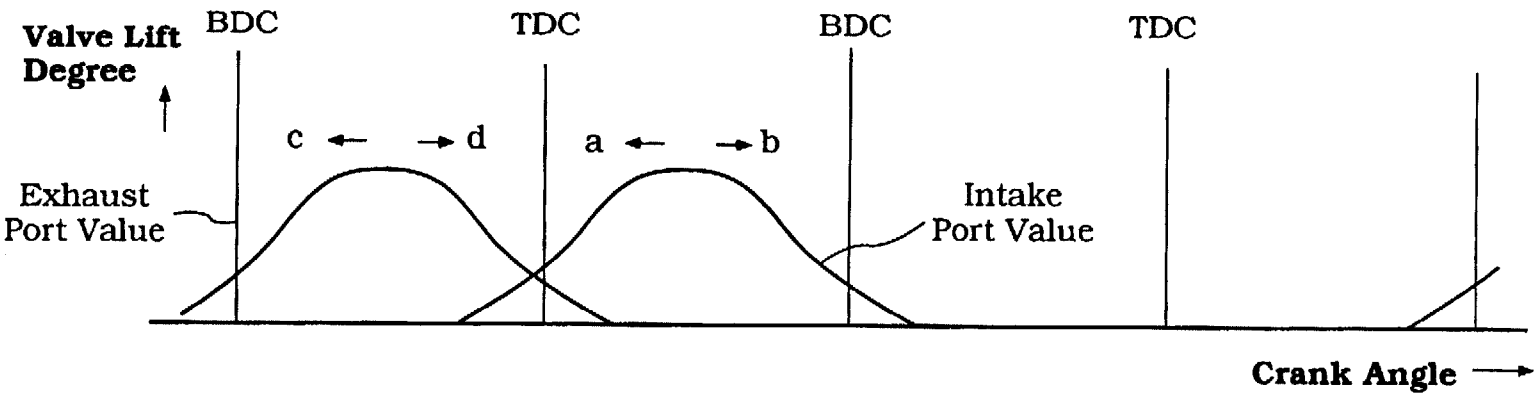
FIG. 11 is a schematic timing chart showing an example of the relationship between a crank angle and the opening of an intake port valve and an exhaust port valve.

In controlling the valve timing, the control unit 21 sends a control signal to an acutuater (not shown in FIG. 2) to change the valve timing, and shifts the opening and closing timing of an intake port valve and an exhaust port valve in directions marked with arrows "a" to "d" in FIG. 11, thereby lowering heat efficiency of the gas engine 1. That is, the time period during which the intake port valve and the exhaust port valve are open is prolonged, thereby introducing more gas into the combustion chamber of the gas engine 1, and increasing exhaust heat radiating from the gas engine. In FIG. 11, the horizontal axis and the vertical axis indicates crank angles and valve lift degrees, respectively, and TDC and BDC denotes top and bottom dead points of crank shaft, respectively.

In controlling the opening of a fuel gas-controlling valve, the control unit 21 sends a control signal to an acutuater (not shown in FIG. 2) to change the opening of a fuel valve so as to increase the opening of a gas flow valve, thereby increasing concentration of fuel gas in mixed gas. As a result, combustion of the mixed gas in the combustion chamber is shifted from a lean burn region to a rich burn region. Accordingly, even though the energy transformed from combustion energy into kinetic energy in the gas engine 1 remains constant, the temperature of the exhaust gas upstream of the exhaust gas heat-exchanger 25 or the amount of exhaust gas is increased, due to an increase in temperature of exhaust gas discharged from the cylinder to an exhaust pipe, delayed combustion in the exhaust pipe, and the like.

Figure 7:
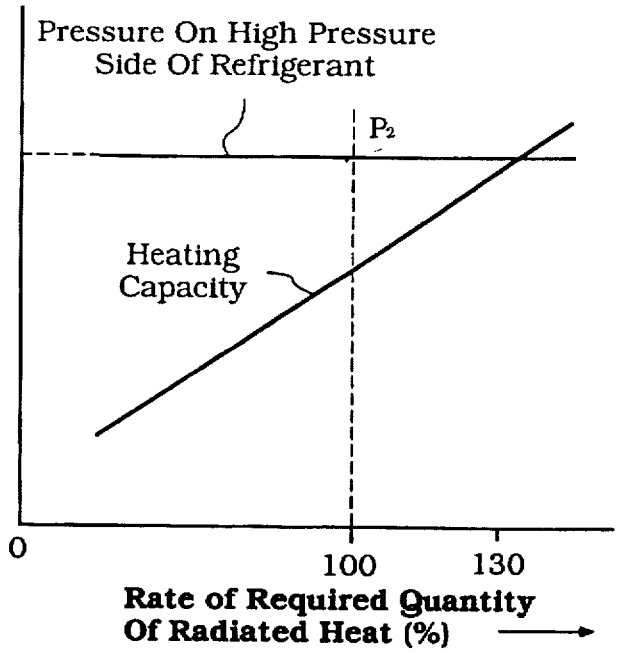
FIG. 7 is a schematic graph showing the relationship between heating power and the pressure on the high pressure side of the refrigerant circulation line versus the rate of the required quantity of radiated heat to the rated quantity of radiated heat, according to the present invention.
Figure 8:
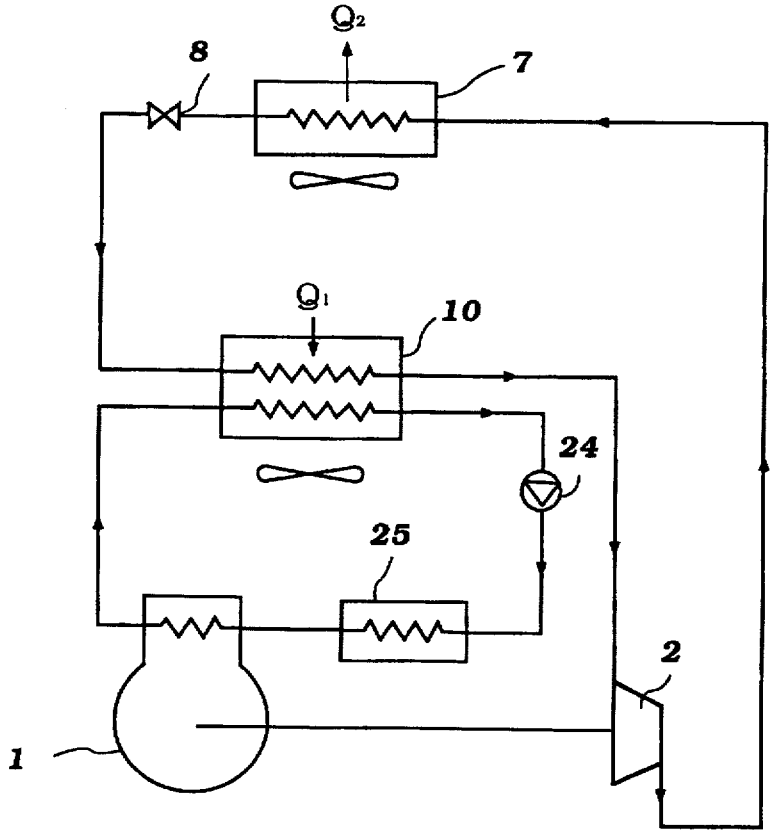
FIG. 8 is a schematic circuit illustrating basic structures of an engine-driven heat pump apparatus.

As shown in FIG. 7, in the above controls, it is possible to maintain pressure $P_2$ on the high pressure side of the refrigerant circulation line without significant fluctuation, irrespective of the number of inside heat-exchangers 7, thereby increasing heating capacity in association with an increase in the required quantity of radiated heat from the inside heat-exchanger, especially when the required quantity of radiated heat exceeds the rated power of the engine (more than 100% of capacity). Incidentally, when the steps for balancing the radiated heat and the heat of evaporation by reducing the radiated heat is employed, heating capacity may not be increased but at least remains constant.

Cooling Operation

The engine-driven heat pump apparatus according to the present invention can be used as an air conditioner for cooling a room by reversing the flow of the refrigerant, i.e., manipulating the four-way valve 6. In the cooling mode, when the outside temperature is low or the number of inside heat-exchangers functioning as evaporators is small, i.e., condensation capacity is higher than evaporation capacity, in order to compensate for insufficient heat of evaporation in the room, the expansion valve control system, the air flow control system, and the engine exhaust heat system (described above) can be used, thereby preventing a liquid return to the inlet of the compressor.

It will be understood by those of skill in the art that numerous variations and modifications can be made without departing from the spirit of the present invention. Therefore, it should be clearly understood that the forms of the present invention are illustrative only and are not intended to limit the scope of the present invention.

We claim:

1. An engine-driven heat pump apparatus comprising a refrigerant circulation line through which a refrigerant circulates, said refrigerant circulation line comprising: an engine-driven compressor for circulating said refrigerant; a cooling water circulation line through which a cooling water for cooling said engine circulates; a cooling water-refrigerant heat-exchanger for exchanging heat between said cooling water and said refrigerant; at least one inside heat-exchanger for exchanging heat between said refrigerant and the air inside a room; an outside heat-exchanger for exchanging heat between said refrigerant and the air outside said room; an expansion valve arranged in series with each inside heat-exchanger; a four-way valve for reversing the flow of said refrigerant at said at least one inside heat-exchanger and at said outside heat-exchanger; and a pressure-controlling device for controlling the pressure difference in said refrigerant circulation line in the area downstream of said compressor and upstream of said expansion valve relative to the pressure upstream of said compressor and downstream of said expansion valve to be at least above a predetermined pressure when the required quantity of radiated heat from said at least one inside heat-exchanger in use is changed.

2. The engine-driven heat pump apparatus according to claim 1, wherein said pressure-controlling device is a device for controlling the opening of said expansion valve.

3. The engine-driven heat pump apparatus according to claim 1, wherein said pressure-controlling device is a device for controlling the volume of air passing through said at least one inside heat-exchanger.

4. The engine-driven heat pump apparatus according to claim 1, wherein said pressure-controlling device is a device for controlling the temperature of air flowing into said at least one inside heat-exchanger by returning a portion of the air flowing out of said at least one inside heat-exchanger to an air inlet of said at least one inside heat-exchanger.

5. The engine-driven heat pump apparatus according to claim 1, wherein said pressure-controlling device is a device for controlling the heat efficiency of said engine.

6. The engine-driven heat pump apparatus according to claim 5, wherein said device for controlling the heat efficiency of said engine is a device for controlling at least one of (a) the ignition timing of said engine, (b) the opening and closing timing of an intake port valve and an exhaust port valve, and (c) the opening of a fuel gas-controlling valve.

7. The engine-driven heat pump apparatus according to claim 1, wherein said cooling water-refrigerant heat-exchanger is disposed in said refrigerant circulation line downstream of said expansion valve and upstream of said compressor.

8. The engine-driven heat pump apparatus comprising a refrigerant circulation line through which a refrigerant circulates, said refrigerant circulation line comprising: an engine-driven compressor for circulating said refrigerant; a cooling water circulation line through which a cooling water for cooling said engine circulates; a cooling water-refrigerant heat-exchanger for exchanging heat between said cooling water and said refrigerant; at least one inside heat-exchanger for exchanging heat between said refrigerant and the air inside a room; an outside heat-exchanger for exchanging heat between said refrigerant and the air outside said room; an expansion valve arranged in series with each inside heat-exchanger; a four-way valve for reversing the flow of said refrigerant at said at least one inside heat-exchanger and at said outside heat-exchanger; and a pressure-controlling device for controlling the pressure in said refrigerant circulation line downstream of said compressor and upstream of said expansion valve, when the required quantity of radiated heat from said at least one inside heat-exchanger in use is changed, said cooling water circulation line being composed of a first channel forming a closed loop through said engine, a second channel forming a closed loop through said engine and a radiator for cooling said cooling water and a third channel forming a closed loop through said engine and said cooling water-refrigerant heat-exchanger, in which said water circulation line is provided with at least one switching valve for controlling the quantity of each cooling water circulating through said respective three channels.

9. A method for stable operation of a heat pump apparatus comprising, in a refrigerant circulation line through which a refrigerant circulates, an engine-driven compressor for circulating said refrigerant; a cooling water circulation line through which a cooling water for cooling said engine circulates; at least one inside heat-exchanger for exchanging heat between said refrigerant and the air inside a room; an outside heat-exchanger for exchanging heat between said refrigerant and the air outside said room; and an expansion valve arranged in series with each inside heat-exchanger; a four-way valve for reversing the flow of said refrigerant at said at least one inside heat-exchanger and at said outside heat-exchanger, said method comprising the step of controlling the pressure difference in said refrigerant circulation line in the area downstream of said compressor and upstream of said expansion valve relative to the pressure in the area upstream of said compressor and downstream of said expansion valve to be at least a predetermined amount when the required quantity of radiated heat from said at least one inside heat-exchanger in use is changed, in such a way as to maintain said pressure.

10. The method for stable operation of the heat pump apparatus according to claim 9, wherein the step of controlling said pressure is conducted while heating the room.

11. The method for stable operation of the heat pump apparatus according to claim 9, wherein the step of controlling said pressure is conducted when the required quantity of radiated heat is increased.

12. The method for stable operation of the heat pump apparatus according to claim 9, wherein the step of controlling said pressure comprises controlling the opening of said expansion valve.

13. The method for stable operation of the heat pump apparatus according to claim 9, wherein the step of controlling said pressure comprises controlling the volume of air passing through said at least one inside heat-exchanger.

14. The method for stable operation of the heat pump apparatus according to claim 9, wherein the step of controlling said pressure comprises controlling the temperature of air flowing into said at least one inside heat-exchanger by returning a portion of the air flowing out of said at least one inside heat-exchanger to an air inlet of said at least one inside heat-exchanger.

15. The method for stable operation of the heat pump apparatus according to claim 9, wherein the step of controlling said pressure comprises controlling the heat efficiency of said engine.

16. The method for stable operation of the heat pump apparatus according to claim 15, wherein the step of controlling exhaust heat comprising lowering the heat efficiency of said engine is conducted with the step selected from the group consisting of controlling the opening of said expansion valve, controlling the volume of air passing through said at least one inside heat-exchanger, and controlling the temperature of air flowing into said at least one inside heat-exchanger by returning a portion of the air flowing out of said at least one inside heat-exchanger to an air inlet of said at least one inside heat-exchanger.

17. The method for stable operation of the heat pump apparatus according to claim 16, wherein the step of lowering the heat efficiency of said engine comprises controlling at least one of (a) the ignition timing of said engine, (b) the opening and closing timing of an intake port valve and an exhaust port valve, and (c) the opening of a fuel gas-controlling valve.

18. The method for stable operation of the heat pump apparatus according to claim 9, wherein said cooling water-refrigerant heat-exchanger is disposed in said refrigerant circulation line downstream of said expansion valve and upstream of said compressor.

19. The method for stable operation of the heat pump apparatus comprising, in a refrigerant circulation line through which a refrigerant circulates, an engine-driven compressor for circulating said refrigerant; a cooling water circulation line through which a cooling water for cooling said engine circulates; at least one inside heat-exchanger for exchanging heat between said refrigerant and the air inside a room; an outside heat-exchanger for exchanging heat between said refrigerant and the air outside said room; and an expansion valve arranged in series with each inside heat-exchanger; a four-way valve for reversing the flow of said refrigerant at said at least one inside heat-exchanger and at said outside heat-exchanger, said method comprising the step of controlling the pressure in said refrigerant circulation line downstream of said compressor and upstream of said expansion valve when the required quantity of radiated heat from said at least one inside heat-exchanger in use is changed in such a way as to maintain said pressure, said cooling water circulation line being composed of a first channel forming a closed loop through said engine, a second channel forming a closed loop through said engine and a radiator for cooling said cooling water, and a third channel forming a closed loop through said engine and said cooling water-refrigerant heat-exchanger, in which said water circulation line is provided with at least one switching valve for controlling the quantity of each cooling water circulating through said respective three channels.

* * * * *